US006336342B1

(12) United States Patent
Zeddies

(10) Patent No.: US 6,336,342 B1
(45) Date of Patent: Jan. 8, 2002

(54) COLLAPSIBLE COOLING PACK

(76) Inventor: William E. Zeddies, P.O. Box 520586, Big Lake, AK (US) 99652

( * ) Notice: Subject to any disclaimer, the term of this patent is extended or adjusted under 35 U.S.C. 154(b) by 0 days.

(21) Appl. No.: 09/612,431

(22) Filed: Jul. 7, 2000

(51) Int. Cl.[7] ..... F25D 3/08; F17C 1/02
(52) U.S. Cl. ..... 62/457.2; 220/592.26
(58) Field of Search ..... 62/457.2, 457.7; 220/592.26, 592.24, 23.9; 206/541, 545; 229/189, 198, 198.2

(56) References Cited

U.S. PATENT DOCUMENTS

| | | | | |
|---|---|---|---|---|
| 4,498,312 | A | | 2/1985 | Schlosser |
| 4,770,338 | A | * | 9/1988 | Tatusch |
| 4,981,022 | A | | 1/1991 | Snyder |
| 4,981,234 | A | | 1/1991 | Slaughter |
| 5,076,711 | A | * | 12/1991 | Koehler, Jr. |
| 5,231,850 | A | | 8/1993 | Morris |
| 5,562,228 | A | | 10/1996 | Ericson |
| D391,121 | S | | 2/1998 | Melk |

FOREIGN PATENT DOCUMENTS

| | | | |
|---|---|---|---|
| JP | 07309338 | A | * 11/1995 |
| JP | 09272530 | A | * 10/1997 |

* cited by examiner

*Primary Examiner*—Henry Bennett
*Assistant Examiner*—Chen-Wen Jiang

(57) ABSTRACT

A collapsible cooling pack for cooling items placed in the pack. The collapsible cooling pack includes a plurality of walls defining an interior. The plurality of walls has a collapsed configuration for being stored and a deployed configuration for receiving items. The plurality of walls comprises a bottom wall, a pair of spaced end walls, and a pair of spaced side walls. The bottom wall has an edge region mounted to an edge region of a first one of the side walls. A first one of the end walls has an edge region mounted to another edge region of the first side wall. A second one of the end walls has an edge region mounted to another edge region of the first side wall. A second one of the side walls has an edge region mounted on another edge region of the second end wall.

19 Claims, 3 Drawing Sheets

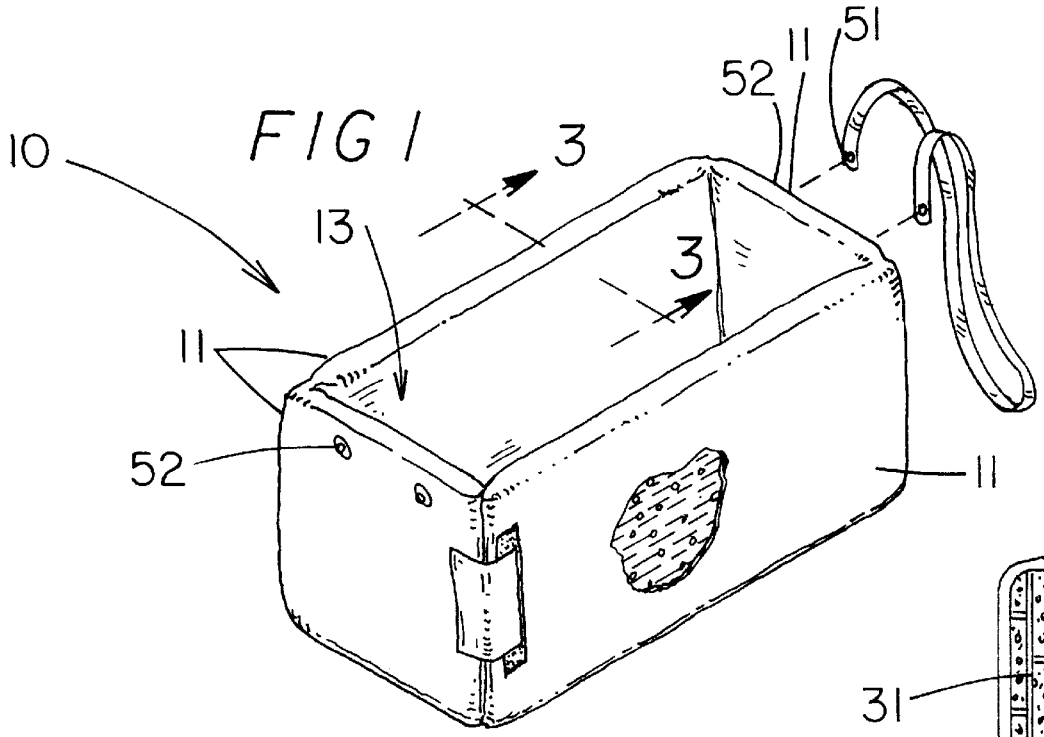
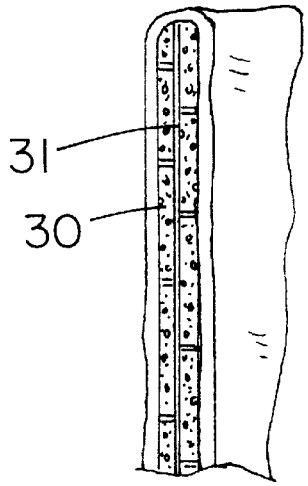
FIG 3
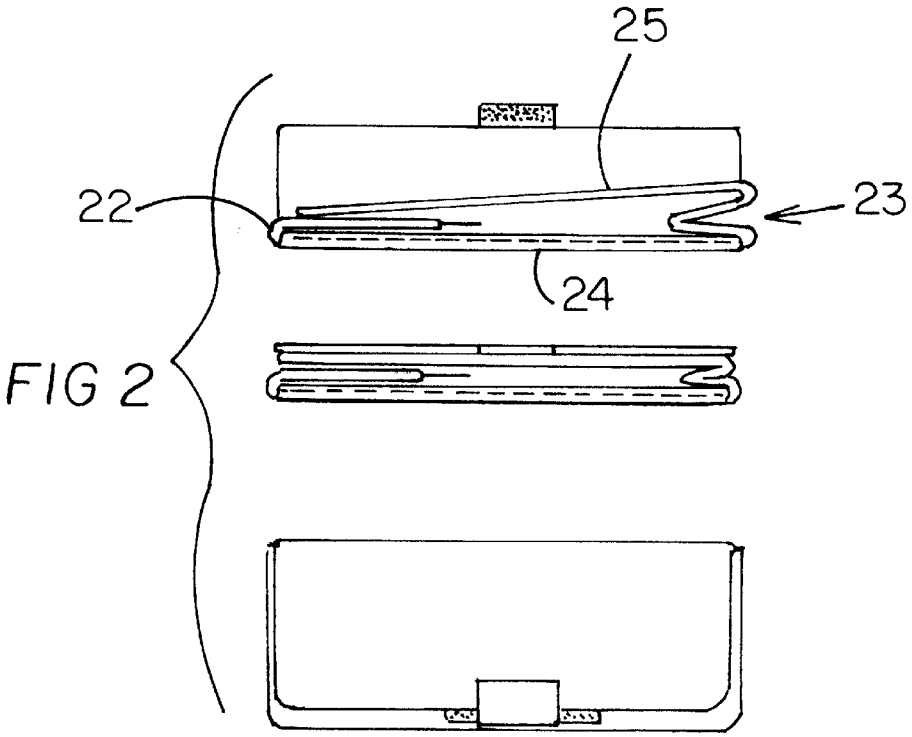

COLLAPSIBLE COOLING PACK

BACKGROUND OF THE INVENTION

1. Field of the Invention

The present invention relates to storage containers and more particularly pertains to a new collapsible cooling pack for cooling items placed in the pack.

2. Description of the Prior Art

The use of storage containers is known in the prior art. More specifically, storage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,23 1,850; U.S. Pat. No. 4,498,312; U.S. Pat. No. 5,562,228; U.S. Pat. No. 4,981,234; U.S. Pat. No. 4,981,022; and U.S. Pat. No. Des. 391 ,121.

While these devices fulfill their respective, particular objectives and requirements, the aforementioned patents do not disclose a new collapsible cooling pack. The inventive device includes a plurality of walls defining an interior. The plurality of walls has a collapsed configuration for being stored and a deployed configuration for receiving items. The plurality of walls comprises a bottom wall, a pair of spaced end walls, and a pair of spaced said walls. The bottom wall has an edge region mounted to an edge region of a first one of the side walls. A first one of the end walls has an edge region mounted to another edge region of the first side wall. A second one of the end walls has an edge region mounted to another edge region of the first side wall. A second one of the side walls has an edge region mounted on another edge region of the second end wall.

In these respects, the collapsible cooling pack according to the present invention substantially departs from the conventional concepts and designs of the prior art, and in so doing provides an apparatus primarily developed for the purpose of for cooling items placed in the pack.

SUMMARY OF THE INVENTION

In view of the foregoing disadvantages inherent in the known types of storage containers now present in the prior art, the present invention provides a new collapsible cooling pack construction wherein the same can be utilized for cooling items placed in the pack.

The general purpose of the present invention, which will be described subsequently in greater detail, is to provide a new collapsible cooling pack apparatus which has many of the advantages of the storage containers mentioned heretofore and many novel features that result in a new collapsible cooling pack which is not anticipated, rendered obvious, suggested, or even implied by any of the prior art storage containers, either alone or in any combination thereof.

To attain this, the present invention generally comprises a plurality of walls defining an interior. The plurality of walls has a collapsed configuration for being stored and a deployed configuration for receiving items. The plurality of walls comprises a bottom wall, a pair of spaced end walls, and a pair of spaced said walls. The bottom wall has an edge region mounted to an edge region of a first one of the side walls. A first one of the end walls has an edge region mounted to another edge region of the first side wall. A second one of the end walls has an edge region mounted to another edge region of the first side wall. A second one of the side walls has an edge region mounted on another edge region of the second end wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible cooling pack apparatus and method which has many of the advantages of the storage containers mentioned heretofore and many novel features that result in a new collapsible cooling pack which is not anticipated, rendered obvious, suggested, or even implied by any of the prior art storage containers, either alone or in any combination thereof.

It is another object of the present invention to provide a new collapsible cooling pack, which may be easily and efficiently manufactured and marketed.

It is a further object of the present invention to provide a new collapsible cooling pack, which is of a durable and reliable construction.

An even further object of the present invention is to provide a new collapsible cooling pack which is susceptible of a low cost of manufacture with regard to both materials and labor, and which accordingly is then susceptible of low prices of sale to the consuming public, thereby making such collapsible cooling pack economically available to the buying public.

Still yet another object of the present invention is to provide a new collapsible cooling pack which provides in the apparatuses of the prior art some of the advantages thereof, while simultaneously overcoming some of the disadvantages normally associated therewith.

Still another object of the present invention is to provide a new collapsible cooling pack for cooling items placed in the pack.

Yet another object of the present invention is to provide a new collapsible cooling pack which includes a plurality of walls defining an interior. The plurality of walls has a collapsed configuration for being stored and a deployed configuration for receiving items. The plurality of walls comprises a bottom wall, a pair of spaced end walls, and a pair of spaced said walls. The bottom wall has an edge region mounted to an edge region of a first one of the side walls. A first one of the end walls has an edge region mounted to another edge region of the first side wall. A second one of the end walls has an edge region mounted to another edge region of the first side wall. A second one of the side walls has an edge region mounted on another edge region of the second end wall.

Still yet another object of the present invention is to provide a new collapsible cooling pack that permits a person to store her perishable items in the collapsible cooling pack while shopping minimizing the possibility of the items spoiling or melting.

Even still another object of the present invention is to provide a new collapsible cooling pack that permits the collapsible pack to be attached to a shopping cart or other vehicle while storing items in the pack.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying, drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a portion of the new collapsible cooling pack according to the present invention.

FIG. 2 is a schematic perspective view of the present invention shown in its stored configuration and in two stages of expansion.

FIG. 3 is a schematic sectional view taken along line 3—3 of the present invention showing an optional wall structure.

DESCRIPTION OF THE PREFERRED EMBODIMENT

Figure 5:
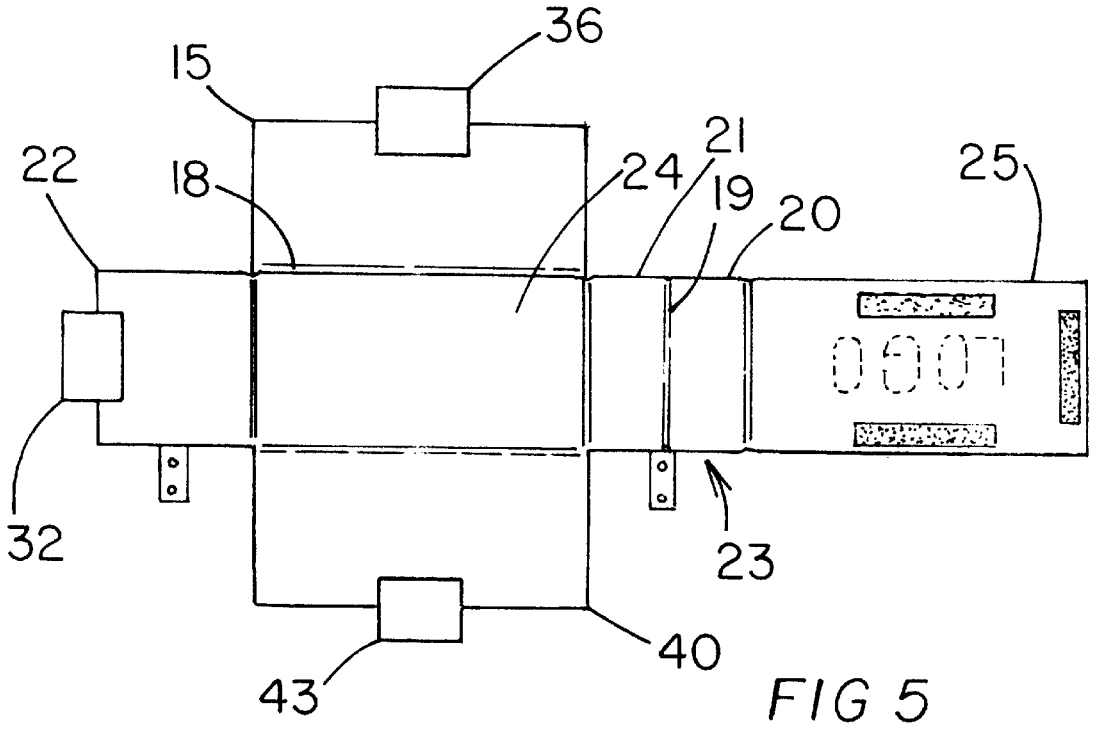
FIG. 5 is a schematic top view of the present invention in an unfolded condition.
Figure 4:
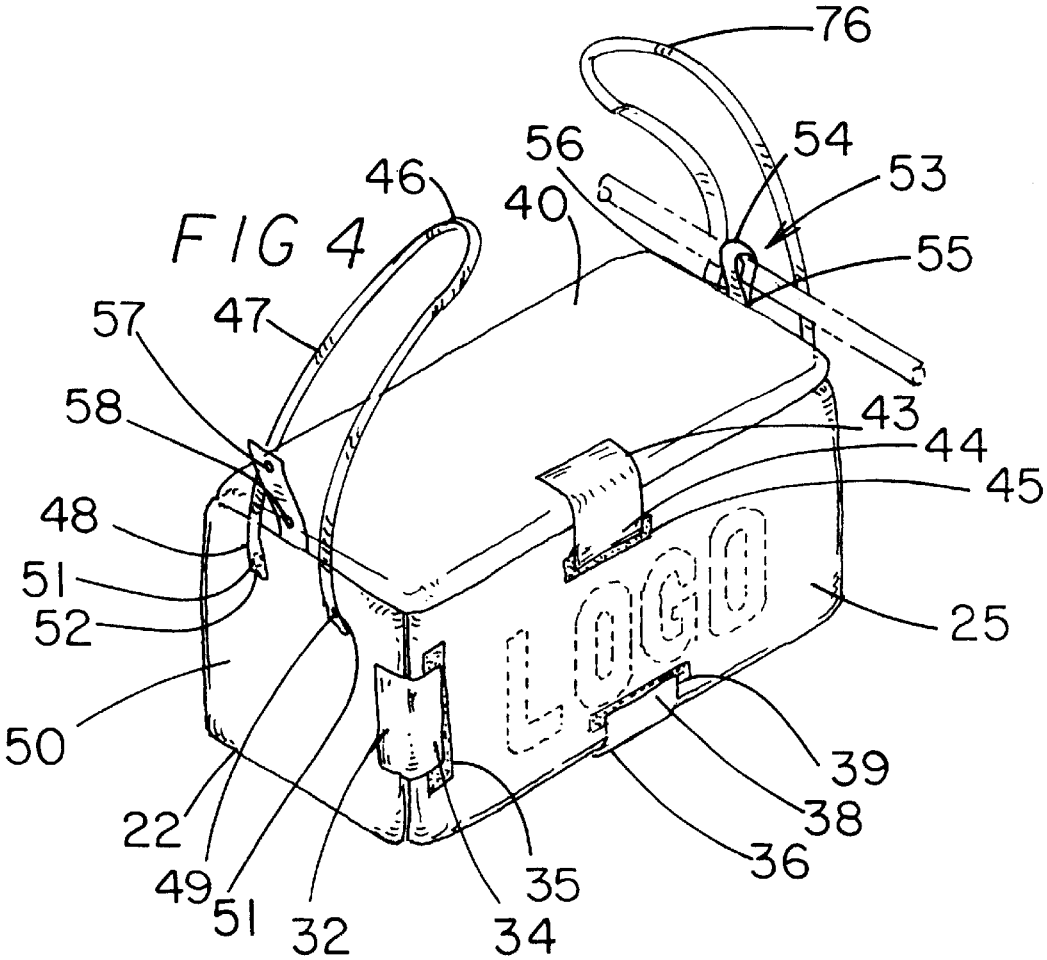
FIG. 4 is a schematic perspective view of the present invention particularly illustrating an optional top wall and a carrying strap and securing loop.
Figure 6:
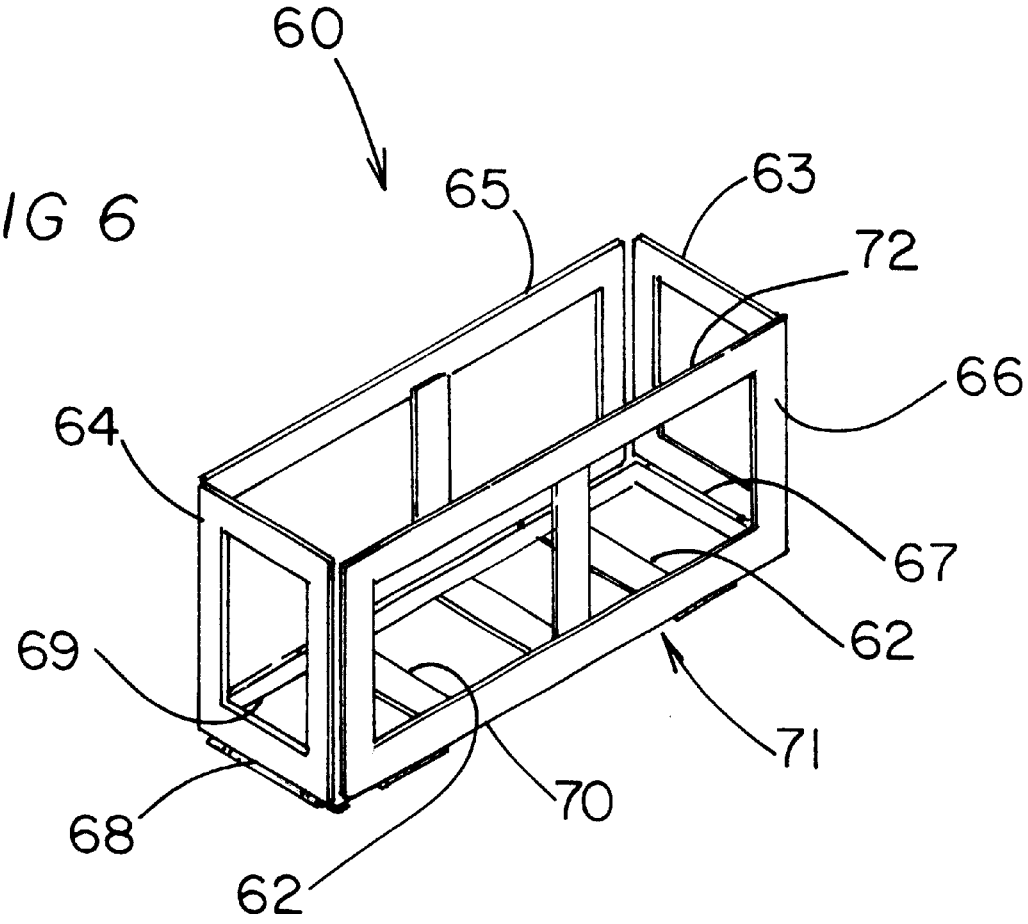
FIG. 6 is a schematic perspective view of the plurality of frames of the present invention shown in condition for use.
Figure 7:
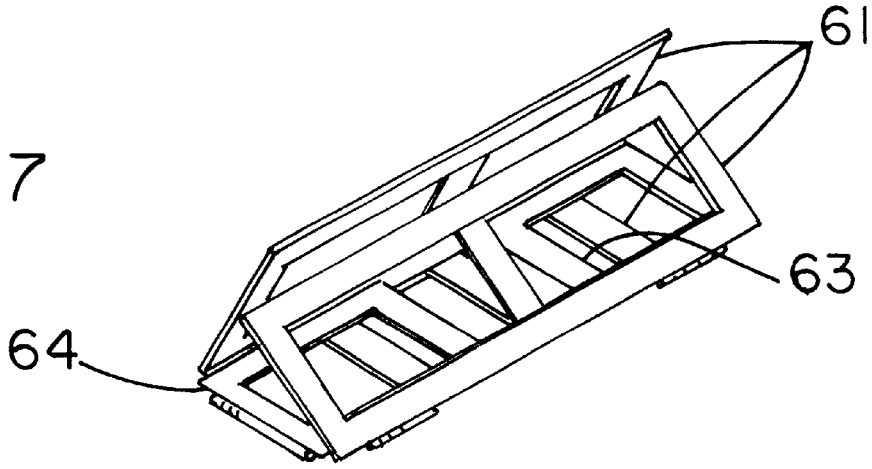
FIG. 7 is a schematic perspective view of the plurality of frames shown in a stored configuration.

With reference now to the drawings, and in particular to FIGS. 1 through 7 thereof, a new collapsible cooling pack embodying the principles and concepts of the present invention and generally designated by the reference numeral 10 will be described.

As best illustrated in FIGS. 1 through 7, the collapsible cooling pack 10 generally comprises a plurality of walls 11 defining an interior 13. The plurality of walls 11 has a collapsed configuration for being stored and a deployed configuration for receiving items. The plurality of walls 11 comprises a bottom wall 15, a pair of spaced end walls 22, 23, and a pair of spaced side walls 24, 25.

The bottom wall 15 has an edge region mounted to an edge region of a first one of the side walls 24. A first one of the end walls 22 has an edge region mounted to another edge region of the first side wall 24. A second one 23 of the end walls has an edge region mounted to another edge region of the first side wall. A second one 25 of the side walls has an edge region mounted on another edge region of the second end wall 23.

A bend line 18 is formed between the end regions of the walls mounted together. The bend line 18 is designed to allow bending at the bend line 18 for permitting adjacent walls 22, 23, 24, 25 on opposite sides of the bend line 18 to be folded into an adjacent condition. The second end wall 23 has a bend line 19 formed therein for permitting portions on opposing sides of the bend line to be folded into an adjacent condition.

Each of the walls 11 may comprise a layer of a thermal-retentive material 30. The thermal-retentive material 30 may comprise a flowable gel material. Each of the walls 11 may comprise a substantially rigid panel 31 positioned adjacent to the thermal-retentive material 30.

A first securing tab 32 is mounted on the first end wall 22. The first securing tab 32 is designed to overlap a portion of the second side wall 25. The first securing tab 32 has a first component 34 of a hook and loop fastener for releasably mounting on a second component 35 of a hook and loop fastener. The second component 35 of a hook and loop fastener is mounted on the second side wall 25.

A second securing tab 36 is mounted on the bottom wall 15. The second securing tab 36 is adapted to overlap a portion of the second side wall 25. The second securing tab 36 has a first component 38 of a hook and loop fastener for releasably mounting on a second component 39 of a hook and loop fastener. The second component of a hook and loop 39 fastener is mounted on the second side wall 25.

The plurality of walls 11 includes a top wall 40. The top wall 40 has an edge region mounted on another edge region of the first side wall 24. The top wall 40 has a closing tab 43 mounted thereon. The closing tab 43 is adapted to overlap a portion of the second side wall 25. The closing tab 43 has a first component 44 of a hook and loop fastener for releasably mounting on a second component 45 of a hook and loop fastener. The second component 45 of a hook and loop fastener is mounted on the second side wall 25.

A first one 22 of the end walls may include a carrying strap 46 for carrying the plurality of walls 11. The carrying strap 46 may be mounted on the first end wall 22. The carrying strap 46 may include a strap member 47. The strap member 47 has opposite ends 48, 49.

Each of the opposite ends 48, 49 may be mounted on an exterior surface 50 of the end wall 22. Each of the opposite ends 48, 49 has a first component 51 of a connector structure and a second component 52 of the connector structure. The second component 52 of the connector structure may be mounted on the end wall 22.

A second carrying strap 76 may be mounted on a second one 23 of the end walls. In one embodiment of the invention, the connector structures 51, 52 may comprise snap connectors.

A first one 22 of the end walls may include a securing loop 53 for securing the end wall 22 to a bar of a shopping cart. The securing loop 53 includes a loop member 54. The loop member 54 has opposite ends 55, 56. One of the 55 opposite ends of the loop may be mounted on the first end wall 22.

The loop member 54 has first 57 and second 58 components of a fastener structure. The first 57 and second 58 components of a fastener structure are mounted on spaced portions of the loop member 54 such that connection of the first 57 and second 58 components form the loop member 54 into a loop configuration. The securing loop 53 may be mounted on a second one 23 of the end walls.

A frame 60 may be provides as a supportive structure for the plurality of walls 11. The frame 60 is adapted to fit in the interior 13 of the plurality of walls 11 when the side 24, 25 and end 22, 23 walls are oriented perpendicular to the bottom wall 15. The frame 60 may comprise a plurality of frame panels 61. The plurality of frame panels 61 may include a bottom frame panel 62, opposite end frame panels 63, 64 and opposite side frame panels 65, 66. The end 63, 64 and side 65, 66 frame panels each have an edge 67, 68, 69, 70 pivotally mounted on an edge 71 of the bottom frame panel 62. Each of the frame panels 61 may include a perimeter member 72 defining an opening.

In use, the plurality of walls are arranged in their deployed configuration. Ideally, the plurality of walls may be stored in a cool location, such as a refrigerator or freezer, prior to being used. The user attaches the hook and loop components on each of the end walls to the appropriate components located on the side wall. The user may then place the plurality of panels inside the interior of walls to provide a rigid structure for the cooling pack.

The user may attach the cooling pack to a shopping cart using the loop structure or may carry the pack using the carrying straps. Perishable items such as milk or ice cream may be placed in the pack while the user shops for other items. After use, the user may return the pack to its stored configuration.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible pack for cooling items placed in the pack, comprising:

a plurality of walls defining an interior, the plurality of walls having a collapsed configuration for being stored and a deployed configuration for receiving items, the plurality of walls comprising a bottom wall, a pair of spaced end walls, and a pair of spaced side walls, the bottom wall having an edge region mounted to an edge region of a first one of the side walls, a first one of the end walls having an edge region mounted to another edge region of the first side wall, a second one of the end walls having an edge region mounted to another edge region of the first side wall, a second one of the side walls having an edge region mounted on another edge region of the second end wall.

2. The pack of claim 1 wherein a bend line is formed between the end regions of walls mounted together to permit bending at the bend line for permitting adjacent walls on opposite sides of the bend line to be folded into an adjacent condition.

3. The pack of claim 1 wherein each of the walls comprises a layer of a thermal-retentive material.

4. The pack of claim 3 wherein the thermal-retentive material comprises a flowable gel material.

5. The pack of claim 3 wherein each of the walls comprises a substantially rigid panel positioned adjacent to the thermal-retentive material.

6. The pack of claim 1 wherein the second end wall has a bend line formed therein for permitting portions on opposing sides of the bend line to be folded into an adjacent condition.

7. The pack of claim 1 wherein a first securing tab is mounted on the first end wall, the first securing tab being adapted to overlap a portion of the second side wall.

8. The pack of claim 7 wherein the first securing tab has a first component of a hook and loop fastener for releasably mounting on a second component of a hook and loop fastener mounted on the second side wall.

9. The pack of claim 7 wherein a second securing tab is mounted on the bottom wall, the second securing tab being adapted to overlap a portion of the second side wall.

10. The pack of claim 9 wherein the second securing tab has a first component of a hook and loop fastener for releasably mounting on a second component of a hook and loop fastener mounted on the second side wall.

11. The pack of claim 1 wherein the plurality of walls includes a top wall having an edge region mounted on another edge region of the first side wall.

12. The pack of claim 11 wherein the top wall has a closing tab mounted thereon, the closing tab being adapted to overlap a portion of the second side wall.

13. The pack of claim 12 wherein the closing tab has a first component of a hook and loop fastener for releasably mounting on a second component of a hook and loop fastener mounted on the second side wall.

14. The pack of claim 1 wherein a first one of the end walls includes a carrying strap for carrying, the plurality of walls, the carrying strap is mounted on the first end wall, the carrying strap includes a strap member having opposite ends, each of the opposite ends being removably mounted on an exterior surface of the end wall.

15. The pack of claim 14 wherein each of the opposite e ends has a first component of a connector structure and a second component of the connector structure being mounted on the end wall.

16. The pack of claim 1 wherein a first one of the end walls includes a securing loop for securing the end walls to a bar of a shopping cart, the securing loop including a loop member having opposite ends with one end mounted on the first end wall, the loop member having first and second components of a releasable fastener structure mounted on spaced portions of the loop member such that connection of the first and second components form the loop member into a loop configuration.

17. The pack of claim 1 additionally comprising a frame for providing a supportive structure for the plurality of walls, the frame being adapted to fit in the interior of the plurality of walls when the side and end walls are oriented perpendicular to the bottom wall, the frame comprising a plurality of frame panels.

18. The pack of claim 17 wherein the plurality of frame panels include a bottom frame panel, opposite end frame panels and opposite side frame panels, the end and side frame panels each having an edge pivotally mounted on an edge of the bottom frame panel.

19. A collapsible pack for cooling items placed in the pack, comprising:

a plurality of walls defining an interior, the plurality of walls having a collapsed configuration for being stored and a deployed configuration for receiving items, the plurality of walls comprising a bottom wall, a pair of spaced end walls, and a pair of spaced side walls, the bottom wall having an edge region mounted to an edge region of a first one of the side walls, a first one of the end walls having an edge region mounted to another edge region of the first side wall, a second one of the end walls having an edge region mounted to another edge region of the first side wall, a second one of the side walls having an edge region mounted on another edge region of the second end wall;

wherein a bend line is formed between the end regions of walls mounted together to permit bending at the bend line for permitting adjacent walls on opposite sides of the bend line to be folded into an adjacent condition;

wherein each of the walls comprises a layer of a thermal-retentive material, wherein the thermal-retentive material comprises a flowable gel material, wherein each of the walls comprises a substantially rigid panel positioned adjacent to the thermal-retentive material;

wherein the second end wall has a bend line formed therein for permitting portions on opposing sides of the bend line to be folded into an adjacent condition;

wherein a first securing tab is mounted on the first end wall, the first securing tab being adapted to overlap a portion of the second side wall, the first securing tab having a first component of a hook and loop fastener for releasably mounting on a second component of a hook and loop fastener mounted on the second side wall;

wherein a second securing tab is mounted on the bottom wall, the second securing tab being adapted to overlap a portion of the second side wall, the second securing tab having a first component of a hook and loop fastener for releasably mounting on a second component of a hook and loop fastener mounted on the second side wall, wherein the plurality of walls includes a top wall having an edge region mounted on another edge region of the first side wall, the top wall having a closing tab mounted thereon, the closing tab being adapted to overlap a portion of the second side wall, the closing tab having a first component of a hook and loop fastener for releasably mounting on a second component of a hook and loop fastener mounted on the second side wall;

wherein a first one of the end walls includes a carrying strap for carrying the plurality of walls, the carrying strap is mounted on the first end wall, the carrying strap includes a strap member having opposite ends, each of the opposite ends being mounted on an exterior surface of the end wall, each of the opposite ends having a first component of a connector structure and a second component of the connector structure being mounted on the end wall, wherein a second carrying strap is mounted on a second one of the end walls, wherein the connector structures comprise snap connectors;

wherein a first one of the end walls includes a securing loop for securing the end walls to a bar of a shopping cart, the securing loop including a loop member having opposite ends with one end mounted on the first end wall, the loop in ember having first and second components of a fastener structure mounted on spaced portions of the loop member such that connection of the first and second components form the loop member into a loop configuration, wherein a securing loop is mounted on a second one of the end walls; and a frame for providing a supportive structure for the plurality of walls, the frame being adapted to fit in the interior of the plurality of walls when the side and end walls are oriented perpendicular to the bottom wall, the frame comprising a plurality of frame panels, the plurality of frame panels including a bottom frame panel, opposite end frame panels and opposite side frame panels, the end and side frame panels each having an edge pivotally mounted on an edge of the bottom frame panel;

wherein each of the frame panels include a perimeter member defining an opening.

* * * * *